US006886738B2

(12) United States Patent
Teixidor Casanovas

(10) Patent No.: US 6,886,738 B2
(45) Date of Patent: May 3, 2005

(54) TRAY FOR THE TRANSPORTATION OF PRODUCTS

(75) Inventor: Pere Teixidor Casanovas, Esparreguera (ES)

(73) Assignee: Paper, S.A., Esparreguera (ES)

( * ) Notice: Subject to any disclaimer, the term of this patent is extended or adjusted under 35 U.S.C. 154(b) by 0 days.

(21) Appl. No.: 10/694,342

(22) Filed: Oct. 27, 2003

(65) Prior Publication Data

US 2004/0084514 A1 May 6, 2004

(30) Foreign Application Priority Data

Oct. 28, 2002 (ES) ..... 200202556

(51) Int. Cl.[7] ..... B65D 5/36; B65D 21/032

(52) U.S. Cl. ..... 229/117.08; 229/117.07; 229/169; 229/172; 229/191; 229/918

(58) Field of Search ..... 229/117.08, 117.03, 229/117.07, 169, 172, 191, 915, 918

(56) References Cited

U.S. PATENT DOCUMENTS 2,734,677 A * 2/1956 Arneson ..... 229/117.07
3,034,698 A * 5/1962 Forrer ..... 229/117.07
4,236,664 A * 12/1980 Hartelmuller ..... 229/191
4,418,863 A * 12/1983 Kimbrell, Sr. ..... 229/169
4,860,948 A * 8/1989 Hofstede ..... 229/169
5,779,136 A * 7/1998 Blazquez Garcia ..... 229/918
6,270,009 B1 * 8/2001 Heeren ..... 229/918
6,378,764 B1 * 4/2002 Teixidor Casanovas ..... 229/191

FOREIGN PATENT DOCUMENTS

EP 394544 A1 * 10/1990 ..... 229/117.07
EP 445442 A1 * 9/1991 ..... 229/169
ES 1029596 5/1995
GB 2205083 A * 11/1988 ..... 229/117.07

* cited by examiner

*Primary Examiner*—Gary E. Elkins
(74) *Attorney, Agent, or Firm*—Steinberg & Raskin, P.C.

(57) ABSTRACT

A tray comprising a bottom of the tray; a couple of headers; a couple of sides; a polygonal column on each of its corners; and two top flaps, each of which extends horizontally from one of the headers to the inner area of the tray is provided. The tray also comprises inclined folding lines that allow the folding of the headers and the sides on the bottom of the tray; wherein the inclined folding lines are located on the headers and on the top flaps. The tray is very strong and, at the same time, can be transported substantially flat, occupying a reduced space.

9 Claims, 4 Drawing Sheets

TRAY FOR THE TRANSPORTATION OF PRODUCTS

This invention refers to a tray for the transportation of products, which is extremely strong and can be transported with a substantially flat configuration.

BACKGROUND OF THE INVENTION

Cardboard trays for the transportation of products, such as fruit, are formed by a sheet equipped with a series of folding lines, which define the bottom of the tray, the headers and the sides.

An important characteristic of these trays is that they must be extremely strong and indestructible so as to tolerate the transportation and bear a great capacity. Therefore, some of the trays that are currently known comprise a top flap over each header, which extends horizontally towards the inner area of the tray.

One drawback which present some of the trays that are currently known is their inability to be folded once they are assembled, which means they have to be assembled immediately before their use or transported already assembled but empty. The latter option is a serious inconvenience as trays take up a lot of space.

So as to solve these inconveniences, different trays for the transportation of products have been designed, such as, for example, the one described in the application for Spanish utility model U9403323. This document describes a tray equipped with the top flaps on the headers and which comprises inclined folding lines on its sides that allow the folding of the tray, adopting a substantially flat configuration. Thanks to this substantially flat configuration, the tray can be transported empty taking up very little space.

However, the tray described in this utility model entails the inconvenience that its strength is not appropriate. Thanks to the presence of the top flaps, the headers are very strong, but the presence of inclined folding lines on the sides makes it less strong.

DESCRIPTION OF THE INVENTION

The tray for the transportation of products of the invention manages to solve the aforementioned inconveniences, and presents other advantages that will be described hereunder.

The tray for the transportation of products of the invention is formed by a sheet provided with a series of folding lines that define:

- the bottom of the tray;
- a couple of headers;
- a couple of sides;
- a polygonal column on each of the corners; and
- two top flaps, each of which extends horizontally from one of the headers to the inner area of the tray; p1 the tray also comprises inclined folding lines that allow the folding of the headers and the sides on the bottom of the tray;
- and wherein the inclined folding lines are located on the headers and on the top flaps.

Thanks to this characteristic, the tray of the invention is very strong and, at the same time, can be transported in a substantially flat position, thus taking up very little space.

Advantageously, each header and top flap comprise two inclined folding lines, that extend from the bottom corners of the header substantially to the centre of the top part of the same.

In order for the tray to be even more strong, each top flap comprises a couple of side flaps that are attached to the outer part of the sides, thus avoiding that the side becomes detached if subjected to excessive tensile force. Furthermore, it allows a reduced internal thickness between the columns and the sides, which facilitates the folding of the tray for its transportation.

Preferably, each top flap comprises a couple of additional folding lines that extend from the corners in contact with the headers towards the inner area of the tray, in the assembly position.

In order to make the tray of this invention even more strong, each column could present an orifice on the top flaps through which a reinforcement member could be inserted in the columns.

If so desired, each orifice can comprise an articulated tongue, which is accommodated inside the column after inserting the reinforcement member. Thanks to this tongue, the inner side of the orifice which the tongue is articulated to, becomes much more strong.

According to a preferred embodiment, the columns are triangular and the side defined by the hypotenuse of the triangle comprises a vertical folding line.

According to two alternative embodiments, the reinforcement member is a triangular plaque or prism formed by a laminar element.

In order for the sides to also have the appropriate strength, the sides have a double thickness.

BRIEF DESCRIPTION OF THE DRAWINGS

So as to enable a better understanding of the terms stated above, a series of drawings have been included to, schematically and illustratively, represent a practical case of the embodiment.

DESCRIPTION OF A PREFERRED EMBODIMENT

Figure 1:
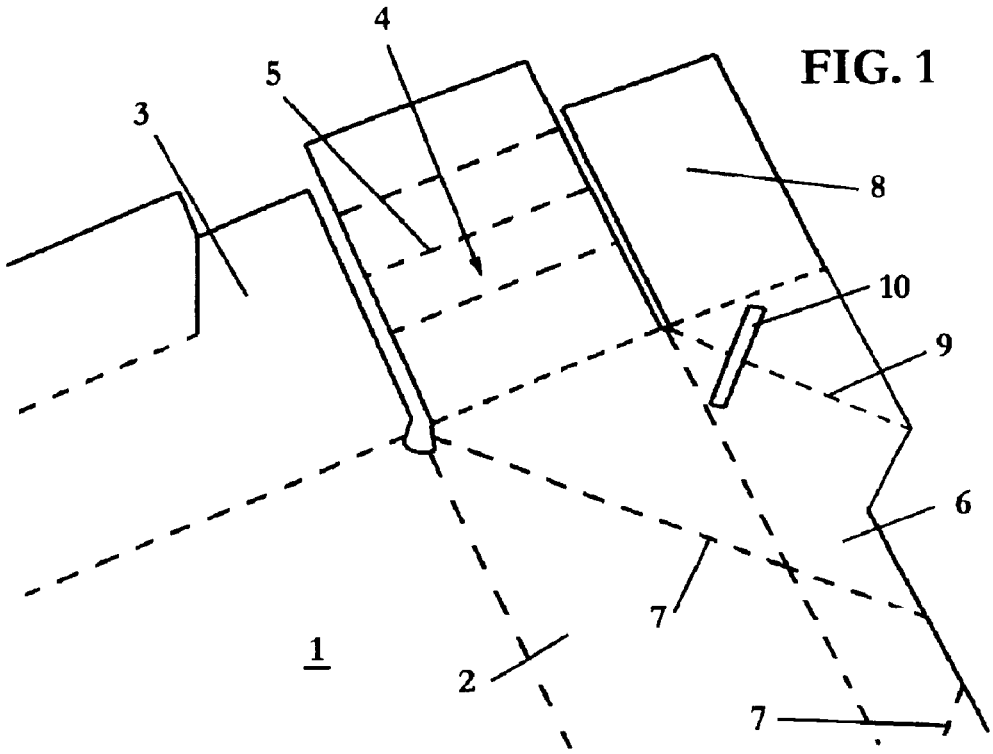
FIG. 1 is a plan view of a fourth of the sheet that forms the tray of the invention when unfolded.
Figure 2:
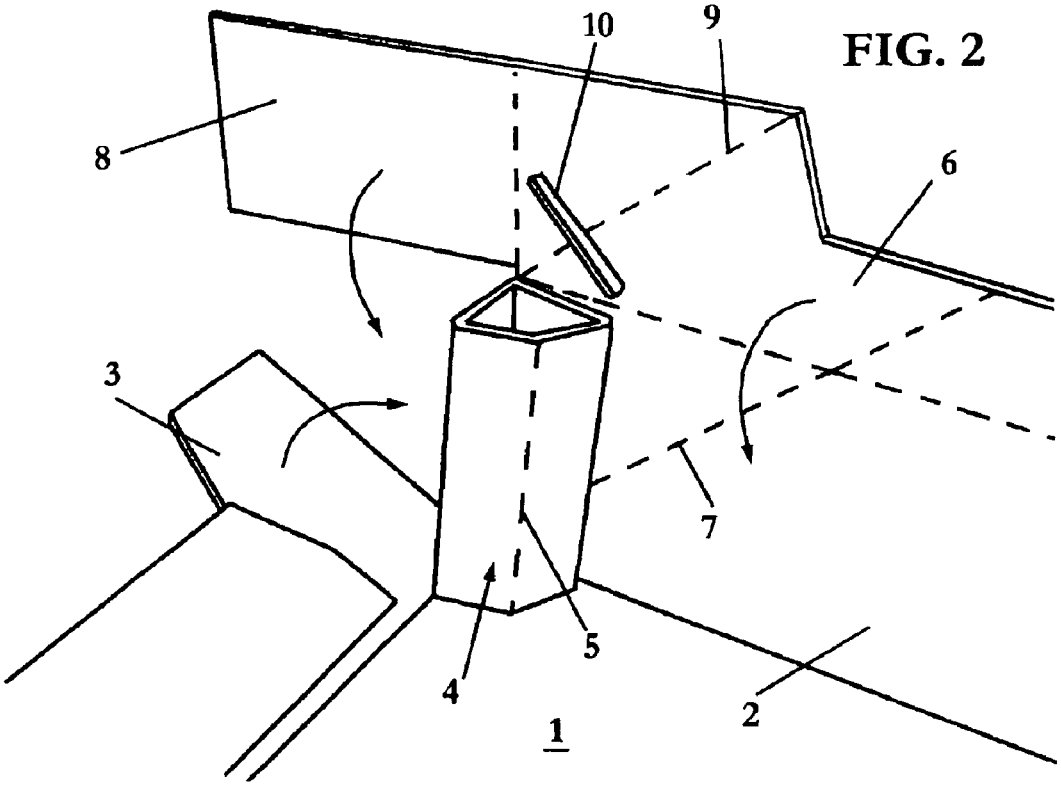
FIG. 2 is a perspective view of one of the corners of the tray of the invention during assembly.

As can be appreciated in FIG. 1, the tray of the invention is formed by a sheet, preferably made of cardboard, that comprises a plurality of folding lines which, once assembled, define a bottom 1, a couple of headers 2, a couple of sides 3, a triangular column 4 on each corner of the tray, and a top flap 6 on each header, each top flap 6 extends horizontally towards the inner area of the tray.

Furthermore, according to the embodiment presented, the represented tray also comprises a side flap 8 on each side of the top flaps 6 and orifices 10 located on the top flaps 6 in correspondence with columns 4. In accordance with the represented embodiment, the width of the side flaps 8 is substantially wider than the width of the top flaps 6. These orifices 10, as will be described below in depth, are used to insert elements for reinforcement 11, 12 in columns 4.

The side of the columns defined by the hypotenuse of the triangle comprises a vertical folding line 5 that allows the folding of the tray once assembled, together with the folding lines described hereunder. If the columns 4 are not triangular, there must be a vertical folding line that enables the folding of the tray.

Headers 2 also comprise inclined folding lines 7,9 to enable the folding of the tray once assembled. The tray, once assembled and folded, has a substantially flat configuration (represented in FIG. 6) that is ideal for its transportation when empty, taking up very little room.

From the unfolded sheet shown in FIG. 1, in the first place the columns 4 are erected, sticking one of their sides to the headers 2. Subsequently, the sides 3, which have a double thickness, are stuck to the columns 4, and the top flaps 6 are folded towards the headers, adopting their definitive horizontal position. Finally, side flaps 8 are stuck on the outer area of the sides 3.

In the case of the represented embodiment, column 4 is formed on the headers 2. However, if so desired, the columns 4 could evidently also be formed on the sides 3.

Figure 3:
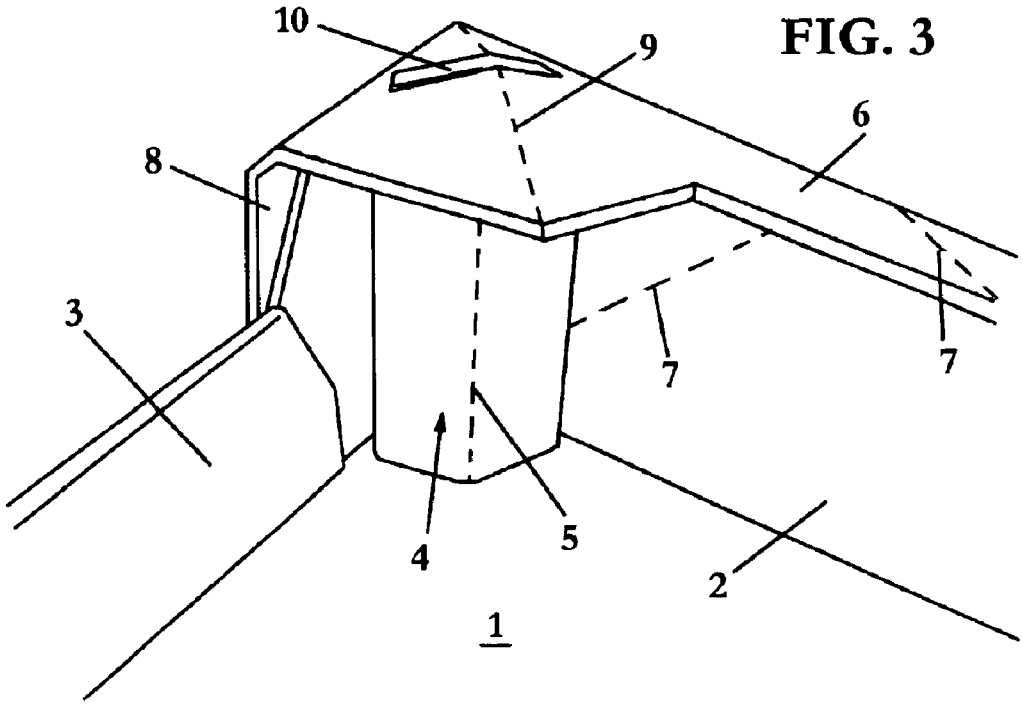
FIG. 3 is a perspective view of one of the corners of the tray of the invention in its upright usage position.
Figure 4:
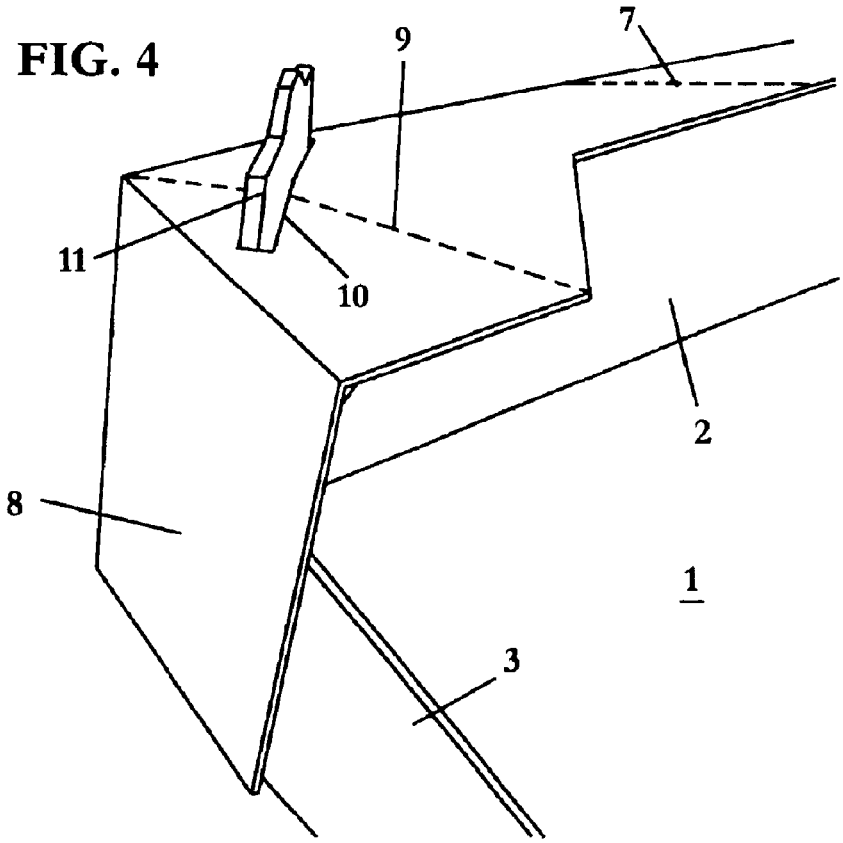
FIG. 4 is a perspective view of a corner of the tray of the invention that comprises a reinforcement member in the columns of the tray, in accordance with a first embodiment.

Once assembled, the tray presents the configuration represented in FIG. 3. In order to increase the strength of the tray of the invention, a reinforcement member 11 can be inserted in each column 4 through an orifice 10. FIG. 4 includes the representation of the reinforcement member 11 with a plaque shape and, in this case, the orifice 10 is shaped like a slot.

Figure 5:
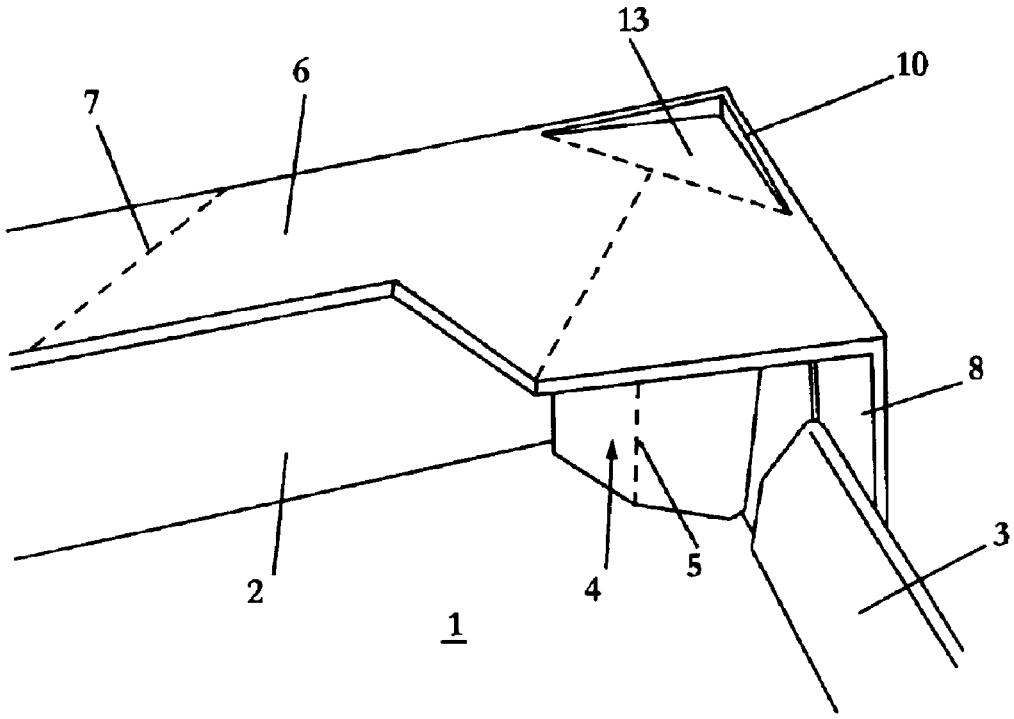
FIG. 5 is a perspective view of a corner of the tray of the invention, in accordance with a second embodiment, including an orifice with an articulated tongue.

Alternatively, as represented in FIG. 5, a reinforcement member 12 could be shaped like a triangular prism, which is inserted in column 4 through a triangular orifice 10. In this case, the triangular prism is formed by a laminar element, that can be transported unfolded taking up very little room.

It is important to state that it is not essential to insert the reinforcement members 11, 12 in columns 4, given that the tray of the invention is already extremely strong even without the reinforcement members 11, 12. Evidently, if the tray is to be used without the reinforcement members 11, 12, orifices 10 are not needed in correspondence with the columns.

As can be seen on FIG. 5, the orifice 10 can comprise an articulated tongue 13 that is accommodated inside the column when the reinforcement member 12 is inserted. Although this is not essential, the presence of the tongue 13 is designed for use with triangular orifices 10.

Figure 6:
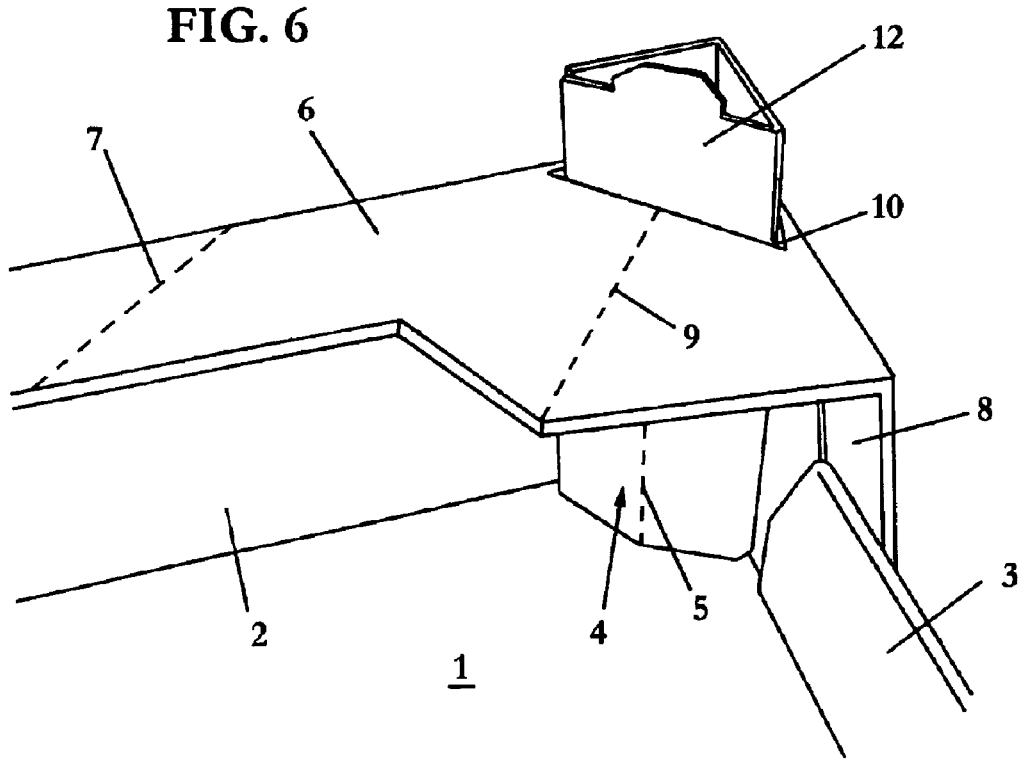
FIG. 6 is a perspective view of a corner of the tray of the invention, that comprises a reinforcement member in the columns of the tray, in accordance with the second embodiment.
Figure 7:
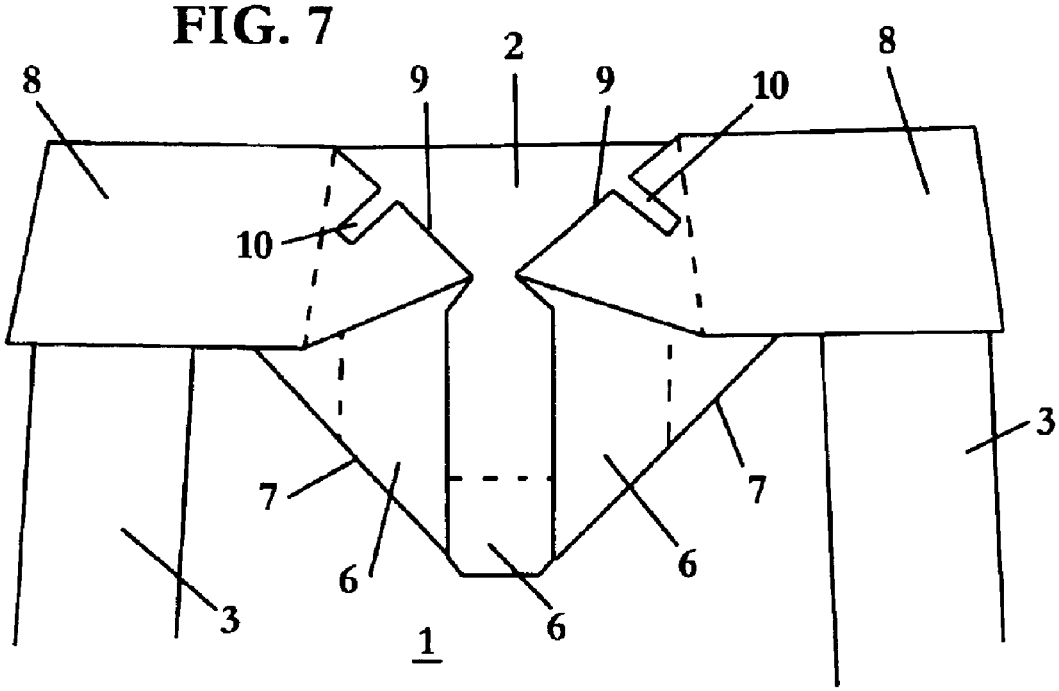
FIG. 7 is a plan view of one of the halves of the tray of the invention in its substantially flat transportation position.

As aforementioned, the tray of the invention can take on an assembled and folded configuration, as can be appreciated in FIG. 6. To achieve this, each header 2 and its corresponding top flap 6 comprise two inclined folding lines 7 that extend from each bottom corner of the header 2 substantially to the top centre of the top flap 6, as can be appreciated in the figures. Furthermore, each top flap 6 also comprises a couple of additional inclined folding lines 9 that extend from the corners in contact with the headers 2 to the inner area of the tray, in the assembly position.

The presence of these folding lines 7,9 and of the vertical folding lines 5 of the columns 4 allow headers 2 and sides 3 to be folded on the bottom 1, with which the tray acquires a substantially flat configuration.

Thus, the tray of the invention can be transported taking up very little room, as it can be placed in its usage position by simply unfolding the headers 2 and the sides 3 and, if required, inserting the reinforcement members 11, 12 in the corresponding orifices 10.

Although this refers to a specific embodiment of the invention, obviously a person skilled in the art will know that the tray for the transportation of products described herein may undergo many variations and modifications and that all the details mentioned may be replaced by others that are technically equivalent, without departing from the scope of protection defined by the claims attached.

What is claimed is:

1. Tray for the transportation of products, formed by a sheet equipped with a series of folding lines that define:

a bottom of the tray;

a couple of headers;

a couple of sides;

a polygonal column on each corner of the tray; and two top flaps, each of which extends horizontally from one of the headers to an inner area of the tray;

the tray also comprises inclined folding lines that allow folding of the headers and the sides on the bottom of the tray; said inclined folding lines are located on the headers and on said top flaps; wherein each column has an associated orifice on the top flaps for insertion of a reinforcement member in said columns.

2. Tray according to claim 1, wherein each header and top flap comprises two inclined folding lines, that extend from lower corners of the header substantially towards a centre of a top part of the top flap.

3. Tray according to claim 1, wherein each top flap comprises a couple of side flaps that are fixed to an outer part of the sides.

4. Tray according to claim 1, wherein each top flap comprises a couple of folding lines, that extend from corners in contact with the headers to an inner area of the tray, in an assembled position.

5. Tray according to claim 1, wherein each orifice comprises an articulated tongue, that is accommodated inside the column when inserting said reinforcement member.

6. Tray according to claim 1, wherein said reinforcement member is plaque shaped.

7. Tray according to claim 1, wherein said columns are triangular, and a side of said columns is defined by the hypotenuse of a triangle which comprises a vertical folding line.

8. Tray according to claim 1, wherein said reinforcement member is a triangular prism formed by a laminar element.

9. Tray according to claim 1, wherein said sides have a double thickness.

* * * * *